United States Patent [19]

Steeg et al.

[11] Patent Number: 4,957,822

[45] Date of Patent: Sep. 18, 1990

[54] LAMINATED MATERIAL FOR FRICTION BEARING ELEMENTS, COMPRISING AN ANTIFRICTION LAYER OF AN ALUMINUM BASED BEARING MATERIAL

[75] Inventors: Michael Steeg, Ober-Olm; Peter Neuhaus, Hochheim/Main; Albert Roth, Frankfurt am Main; Ulrich Engel, Bad Schwalbach, all of Fed. Rep. of Germany

[73] Assignee: Glyco-Metall-Werke Daelen & Loos GmbH, Wiesbaden, Fed. Rep. of Germany

[21] Appl. No.: 476,522

[22] Filed: Feb. 7, 1990

Related U.S. Application Data

[63] Continuation-in-part of Ser. No. 303,926, Jan. 30, 1989, which is a continuation-in-part of Ser. No. 124,617, Nov. 24, 1987, abandoned.

[30] Foreign Application Priority Data

Nov. 26, 1986 [DE] Fed. Rep. of Germany ..... 3640328
Sep. 3, 1987 [DE] Fed. Rep. of Germany ..... 3729414

[51] Int. Cl.[5] ..... B32B 15/00; B32B 15/10; F16C 33/06

[52] U.S. Cl. ..... 428/653; 428/645; 384/912

[58] Field of Search ..... 428/645, 653; 384/912

[56] References Cited

U.S. PATENT DOCUMENTS 3,753,695 8/1973 Lloyd ..... 428/653
3,955,936 5/1976 LeBrasse et al. ..... 428/653

FOREIGN PATENT DOCUMENTS

P3640328 11/1986 Fed. Rep. of Germany .
3519452 12/1986 Fed. Rep. of Germany .
P3729414 9/1987 Fed. Rep. of Germany .

*Primary Examiner*—Theodore Morris
*Assistant Examiner*—Robert Koehler
*Attorney, Agent, or Firm*—H. Gibner Lehmann; K. Gibner Lehmann

[57] ABSTRACT

In a laminate for friction bearing elements which contains, on a metallic support layer, an anti-friction layer comprising an aluminum alloy containing nickel, manganese and lead, there is additionally provided bismuth or copper which improve considerably the bearing properties and also facilitate the surface machining by chip removal of the anti-friction layer. It is of particular advantage if the aluminum alloy has the addition of both bismuth and copper, resulting in considerably improved sliding characteristics and improved emergency running properties in addition to substantially improved properties regarding strength, dynamic loadability, fatigue strength and good machinability.

17 Claims, 3 Drawing Sheets

LAMINATED MATERIAL FOR FRICTION BEARING ELEMENTS, COMPRISING AN ANTIFRICTION LAYER OF AN ALUMINUM BASED BEARING MATERIAL

CROSS REFERENCES TO RELATED APPLICATIONS

The present application is a continuation-in-part and claims benefit under 35 USC 120 of our copending application, Ser. No. 07/303,926 filed Jan. 30, 1989, which is about to become abandoned. Ser. No. 07/303,926 is a continuation-in-part and claims the benefit under 35 USC 120 of our application Ser. No. 124,617 filed Nov. 24, 1987, now abandoned, both prior U.S. applications having common ownership with the present application. U.S. Appl. Ser. No. 124,617 claims priority under 35 USC 119, of both German Application No. P 36 40 328.8 filed Nov. 26, 1986, and German Application No. P 37 29 414.8 filed Sept. 3, 1987.

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

FIELD OF THE INVENTION

This invention relates to laminated materials for friction bearing elements, e.g. radial friction bearings or thrust friction bearings, such materials consisting of a metallic support or base layer and an anti-friction layer applied to the base layer and comprising an aluminum-based bearing material which optionally can have an applied binder layer and accommodation layer, said bearing material being an essentially homogeneous aluminum alloy containing nickel, manganese and lead.

DESCRIPTION OF THE RELATED ART INCLUDING INFORMATION DISCLOSED UNDER 37 CFR §§1.97–1.99

While a laminate of this kind as known from the Federal Republic of Germany Printed Patent Publication No. 35 19 452 does have excellent bearing properties together with an increased dynamic loadability of the anti-friction layer made of such bearing material, it has turned out in practice that in the manufacture and processing of this known laminate, certain difficulties are encountered, particularly during surface machining by chip removal, e.g. in that there is a strong tendency to form built-up edges. It has further turned out in practice that this known laminate needs to be improved yet with respect to its hardness, tensile strength and fatigue strength, and especially with respect to the emergency running properties of the anti-friction layer made out of such bearing material.

Hard particles deposit at grain boundaries and displacements occur which leads to displacement pile-ups and, hence, to compaction. In addition the immigration of displacements and sliding of the grain boundaries is hindered.

There occurred difficulties involving a great tendency to form built-up edges.

SUMMARY OF THE INVENTION

This problem is solved by the characterizing features of appended claim 1.

Due to the invention, the advantageous characteristics of the known laminate of this kind with respect to fatigue strength, adaptability and especially temperature consistency of the antifriction layer and with respect to the latter's emergency running properties are improved, or at least retained fully. Moreover, increase sliding ability and considerably improved emergency running properties are imparted to the anti-friction layer as provided by the invention. But above all, due to the invention, the chip removing machinability of the bearing alloy of aluminum with nickel content and manganese content is substantially improved. When surface machining by chip removal, the resultant chips are short, which is a prerequisite for materials machined on automated equipment. In addition, the formation of built-up edges is prevented.

While it has already been taken into consideration, according to DE-PS No. 35 19 452 to improve the machinability at slow cutting speeds by adding small amounts of lead to the alloy, these lead additions have left open the demand for further improvement of the machinability by chip removal, particularly during surface machining by chip removal.

As in the laminate known from the Federal Republic of Germany Printed Patent Publication No. 35 19 452, if the bearing material forming the anti-friction layer is not completely homogeneous, hard nickel and manganese particles or hard particles containing nickel and/or manganese may be permissible. Applicants have discovered that improved strength can be attained if the particle size is essentially less than or equal to 5 microns; and that less than 5 particles, preferably no more than 1 particle of a size greater than or equal to 5 microns be present in a volume element of a cube of 0.1 mm edge length.

It is of particular advantage within the scope of the present invention if the aluminum alloy contains 1 percent to 3 percent nickel by weight, and 0.1 percent to 2.5 percent manganese by weight. It is further especially advantageous within the scope of the invention if the bismuth addition in the aluminum alloy according to the invention amounts to between 0.1 percent and 3 percent by weight.

A second advantageous solution of the posed problem consists in that the aluminum alloy forming the bearing material contains additional copper in an amount of from 0.02 percent and 1.5 percent by weight.

Limiting the additional copper, according to the invention, to between 0.02 and 1.5 percent by weight means that the additional copper becomes markedly increased over the copper content found in the aluminum alloy, which is permissible as an impurity in the aluminum; on the other hand the copper content should not be above an amount at which a hardening of the alloy occurs.

What the additional copper achieves, according to the invention, is that besides the mixed crystal strengthening of the bearing material in the aluminum/nickel/-manganese alloy with copper addition as known from the Federal Republic of Germany Printed Patent Publication No. 35 19 452, there also occur ternary and quaternary phases or crystal types which, due to their hardness, cause the strength of the aluminum matrix to increase. As an additional advantage of the invention, the aluminum/nickel/manganese/copper alloy offers the possibility of predetermined control of the strength values that may be desired and required for each individual application, by selecting appropriate heat treatment temperatures and/or heat treatment cycles in the course of their processing. As far as can be understood, control of the mixed crystal supersaturation and the size and amount of the precipitations.

It has proved to be particularly advantageous, within the scope of the invention, to have the aluminum alloy contain 1 to 3 percent nickel by weight and 0.1 to 2.5 percent manganese by weight.

As a third especially advantageous solution of the posed problem, it was found that the aluminum/nickel/-manganese alloy can contain, in combination:

a bismuth addition of between 0.1 and 3 percent by weight, and a copper addition of between 0.02 and 1.5 percent by weight.

In this context, the combination of a bismuth addition of between 0.3 and 3 percent by weight and a copper addition of between 0.3 and 0.8 percent by weight is particularly advantageous.

With this combination of bismuth and copper additions to the aluminum/nickel/manganese alloy, the mixed crystal strengthening present in a bearing material based on aluminum/nickel/manganese as known from the Federal Republic of Germany Printed Patent Publication No. 35 19 452 is further improved in that the ternary and quarternary phases or mixed crystal types brought about by the addition of copper effect a considerable increase of the strength values of the aluminum alloy on the one hand, yet do not impair its machinability, especially its machinability by chip removal, on the other hand. As an additional advantage, the aluminum/-nickel/manganese alloy with the combination of bismuth and copper additions offers the possibility of considerably improving the control of the strength levels to be exercised in the course of the manufacturing process, by the selection of appropriate heat treatment temperatures or heat treatment cycle control measures to be taken in the course of processing for the level of the strength values required. It has turned out that the copper addition and the bismuth addition in the alloy according to the invention do not influence each other adversely, but in their interaction achieve considerably better slidability and improved emergency running properties of an anti-friction layer made of such an alloy. In addition, a much improved stabilization of the friction bearing characteristics of an anti-friction layer made of aluminum/nickel/manganese alloy with combined copper additions and bismuth additions is had.

Other features and advantages will hereinafter appear.

BRIEF DESCRIPTION OF THE DRAWING

Embodiment examples of the invention are described below in greater detail with reference to the drawing, in which.

DESCRIPTION OF THE PREFERRED EMBODIMENTS

Figure 1:
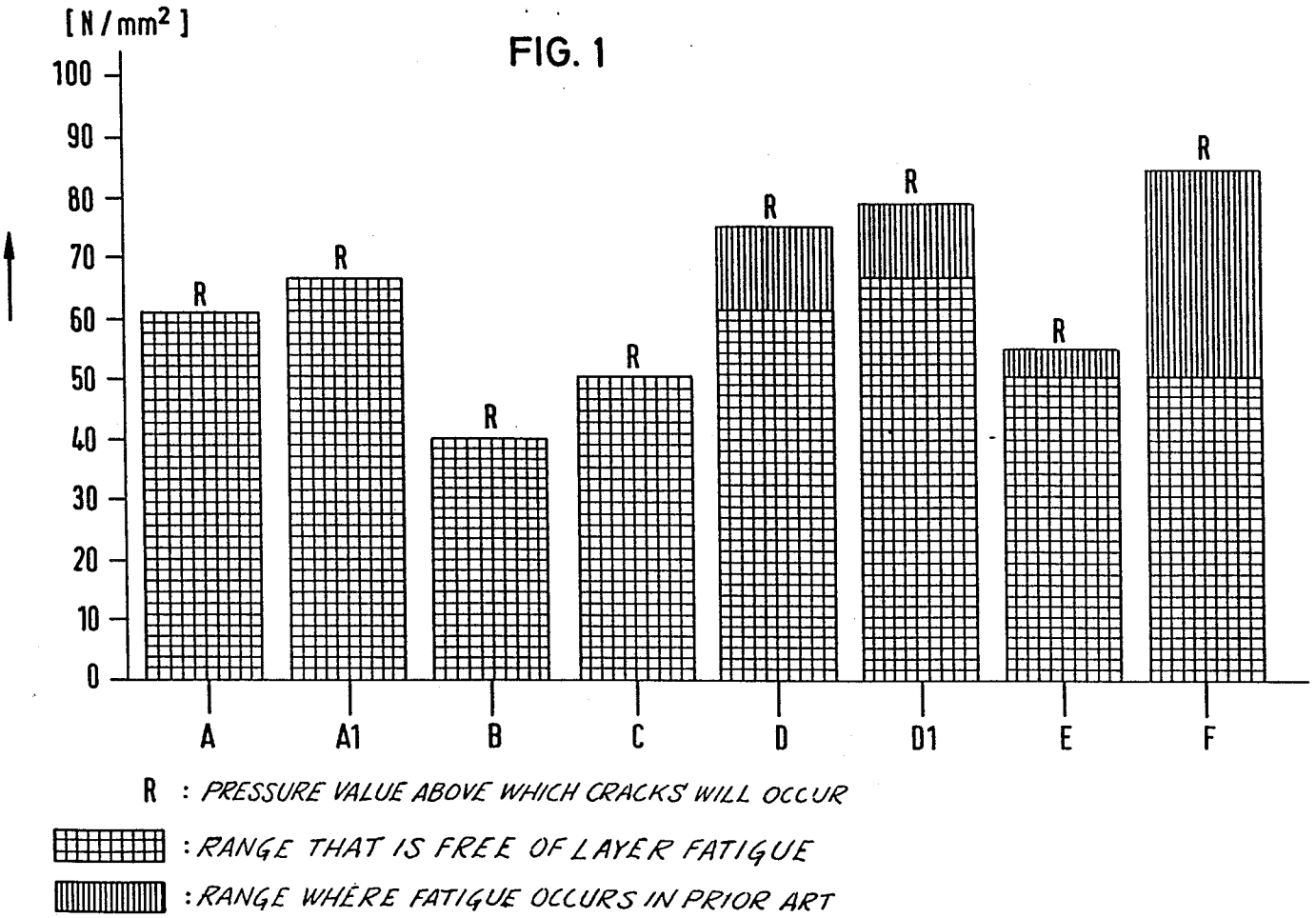
FIG. 1 shows a bar diagram for the dynamic loadability for various laminates.
Figure 5:
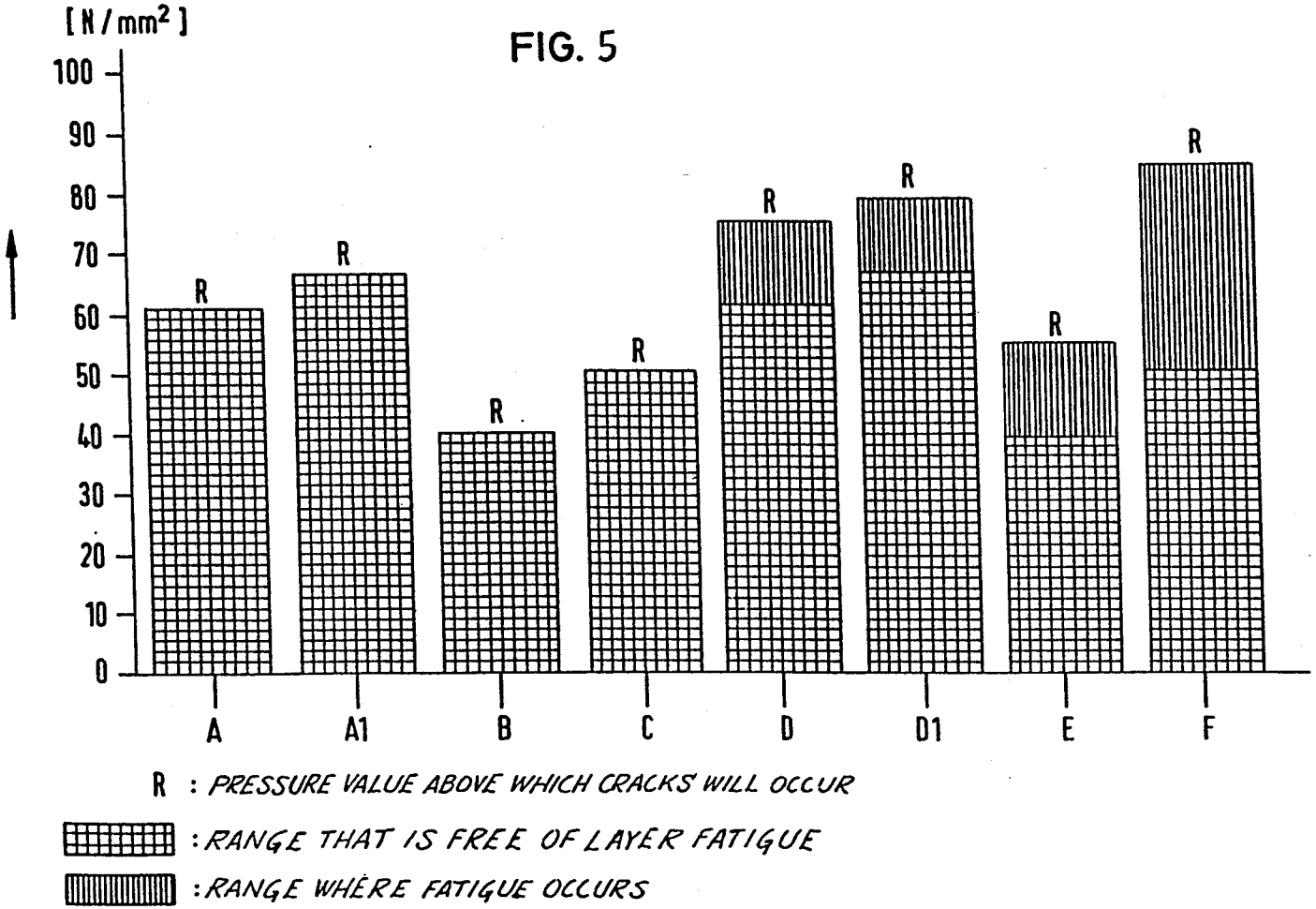
FIG. 5 is a bar diagram for the dynamic loadability for laminates according to other embodiments.

The bar diagrams shown in FIGS. 1 and 5 involve the representation of the dynamic loadability of laminates with antifriction layers on based on aluminum, relative to 200 hours. The dynamic loadability is determined from residual load curves of Underwood tests at 150° C. The initially compared laminates had a support material of steel and an anti-friction layer applied to the support layer by cladding it with a cast aluminum sheet, possibly with the interposition of a pure aluminum foil.

The laminates compared to each other in the bar diagram of FIG. 1 are as follows:

A: Steel/$AlNi_2Mn_1Bi_2$, without bonding layer and adaptation layer, with hard particles of Al, Ni and Mn, in combination.

Al: Steel/$AlNi_2Mn_1Bi_2$ with 0.5 weight percentage Cu, without bonding layer and adaptation layer, with hard particles of Al, Ni and Mn in combination.

B: Steel/$AlSn_6$, conventional, without bonding layer or adaptation layer.

C: Steel/$AlSn_{20}$, conventional, without bonding layer or adaptation layer.

D: Steel/$AlNi_2Mn_1Bi_2$/Ni/$PbSn_{10}Cu_2$ (electroplated) with Ni bonding layer and $PbSn_{10}Cu_2$ adaptation layer, both applied by electroplating, with hard particles of Al, Ni and Mn in combination.

D1: Steel/$AlNi_2Mn_1Bi_2Cu_{0.5}$/$PbSn_{10}Cu_2$ (electroplated) Ni bonding layer and $PbSn_{10}Cu_2$ adaptation layer, both applied by electroplating, with hard particles of Al, Ni and Mn in combination.

E: Steel/$AlSn_6$/Ni/$PbSN_{10}Cu_2$ (electroplated), conventional, with Ni bonding layer and $PbSn_{10}Cu_2$ adaptation layer, both applied by electroplating.

F: Steel/$AlZn_5$/Ni/$PbSn_{10}Cu_2$ (electroplated), known high-strength Al bearing material, with Ni bonding layer and $PbSn_{10}Cu_2$ adaptation layer, both applied by electroplating.

As the bar diagram demonstrates, a dynamic loadability of more than 60 N/mm$^2$ is achievable with a laminate with a steel support layer and an $AlNi_2Mn_1Bi_2$ anti-friction layer before cracks in the aluminum layer are detectable. Such an $AlNi_2Mn_1Bi_2$ anti-friction layer is excellently machinable with cutting tools and distinguishes itself by its increased sliding ability and, compared to known anti-friction layer, by its considerably improved emergency running properties. As shown in the bar diagram at A1, such an anti-friction layer can yet be improved by an addition of 0.5% Cu by weight, to the effect that a dynamic loadability of about 65 N/mm$^2$ is reached before cracks in the aluminum layer are detectable.

As is evident from part D of the bar diagram, the dynamic loadability of friction bearing can yet be raised into the range where slide layer fatigue normally occurs, up to about 75 N/mm$^2$ until fatigue cracks are detectable in the aluminum layer, by the application of a nickel bonding layer and a $PbSn_{10}Cu_2$ adaptation layer to the anti-friction layer. Also in the case of the laminate to which part D of the bar diagram refers, an increase in the fatigue strength can yet be achieved, namely by the addition of 0.5% by weight of Cu to the $AlNi_2Mn_1Bi_2$ alloy. As may be seen from part D1 of the bar diagram, it is possible in this manner to reach a dynamic loadability of the laminate up to 80 N/mm$^2$ before fatigue cracks are detectable in the aluminum layer. Additionally, the laminates corresponding to parts D and D1 of the bar diagram distinguish themselves by much improved machinability with cutting tools of the bearing material forming the anti-friction layer, as well as by increased slidability and improved emergency running properties. Such improved characteristic and dynamic loadability values cannot be obtained with the conventional friction bearing materials intended for medium loadability, as the examples B, C, and E for $AlSn_6$ and $AlSn_{20}$ with or without adaptation layer demonstrate. The dynamic loadability of friction bearings with anti-friction layer of cast $AlNi_2Mn_1Bi_2$ bearing alloy already approaches the order of magnitude so far known only for high-strength aluminum bearing materials, e.g. the bearing material with anti-friction layer of cast $AlZn_5$ alloy represented in Example F. The dynamic loadability of friction bearings with anti-friction layer of cast $AlNi_2Mn_1Bi_2$ bearing alloy with copper added of between 0.02% and 1.5% by weight already makes it possible to reach this order of magnitude. The fatigueless operating range of an anti-friction layer of $AlNi_2Mn_1Bi_2$ bearing alloy with 0.5% by weight added copper is even better than that of an anti-friction layer of cast $AlZn_5$ alloy if identical adaptation layers are provided in both anti-friction layers. Furthermore, the known cast $AlZn_5$ alloy cannot be applied without the adaptation layer and, with respect to other bearing material properties such as resistance to seizing, wear resistance, etc. its characteristics are considerably worse than those found for the bearing alloy on aluminum basis with the stated small additions of manganese, nickel and bismuth as well as possibly copper.

The laminates compared in the bar diagram of FIG. 5 are as follows:

A: Steel/$AlNi_2Mn_1$, without bonding layer and adaptation layer, with hard particles of Al, Ni and Mn in combination.

Al: Steel/$AlNi_2Mn_1$ with 0.5% by weight added copper, according to the invention, without bonding layer and adaptation layer, with hard particles of Al, Ni and Mn in combination.

B: Steel/$AlSn_6$, conventional, without bonding layer and adaptation layer.

C: Steel/$AlSn_{20}$, conventional, without bonding layer and adaptation layer.

D: Steel/$AlNi_2Mn_1$/Ni/$PbSn_{10}Cu_2$ (electroplated) according to the main patent, with Ni bonding layer and $PbSn_{10}Cu_2$ adaptation layer, both applied by electroplating, with hard particles of Al, Ni and Mn in combination.

D1: Steel/$AlNi_2Mn_1Cu_{0.5}$/Ni/$PbSn_{10}Cu_2$ (electroplated) according to the invention, Ni bonding layer and $PbSn_{10}Cu_2$ adaptation layer, both applied by electroplating, with hard particles of Al, Ni and Mn in combination.

E: Steel/$AlSn_6$/Ni/$PbSn_{10}Cu_2$ (electroplated), conventional, with Ni bonding layer and $PbSn_{10}$ adaptation layer, both applied by electroplating.

F: Steel/$AlZn_5$/Ni/$PbSn_{10}Cu_2$ (electroplated), known high-strength Al bearing material with Ni bonding layer and $PbSn_{10}Cu_2$ adaptation layer, both applied by electroplating.

As the bar diagram shows, portion A1, a dynamic loadability of approximately 65 N/mm$^2$ is attainable with a laminate having a steel support layer and an anti-friction layer of $AlNi_2Mn_1$ with 0.5% by weight of added copper before cracks in the aluminum layer are detectable. As may be seen from part D1 of the bar diagram, the dynamic loadability of friction bearings can yet be raised into the range where friction layer fatigue normally occurs, up to about 80 N/mm$^2$, until fatigue cracks in the aluminum layer are detectable, by the application of a nickel bonding layer and a $PbSn_{10}Cu_2$ adaptation layer to the anti-friction layer. Such figures are not attainable with the conventional friction bearing materials based on aluminum and intended for medium loadability, as demonstrated by the Examples B, C and E for $AlSn_6$ and $AlSn_{20}$ with or without adaptation layer. Accordingly, the dynamic loadability of friction bearings with anti-friction layer of cast $AlNi_2Mn_1$ bearing alloy with copper added between 0.002% and 1.5% by weight permits attaining an order of magnitude hitherto known only in high-strength aluminum bearing materials, such as a bearing material with an anti-friction layer of cast $AlZn_5$ alloy represented by Example F, the fatigueless operating range of an anti-friction layer of $AlNi_2Mn_1$ bearing alloy with 0.5% by weight added copper being even higher than that of an anti-friction layer of cast $AlZn_5$ alloy, if identical adaptation layers are applied to both anti-friction layers. Furthermore, the known cast $AlZn_5$ alloy cannot be used without the adaptation layer, and with respect to other bearing material properties such as resistance to seizing, wear resistance, etc. its characteristics are far less favorable than those found for bearing alloys based on aluminum with the stated small additions of manganese, nickel, and copper.

Figure 2:
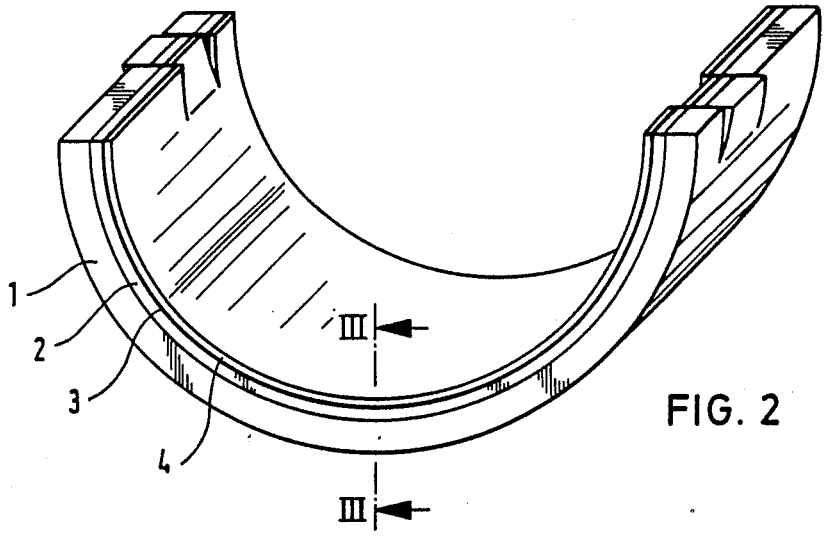
FIG. 2 is a perspective view of the laminate according to the invention in the form of a friction bearing half.
Figure 3:
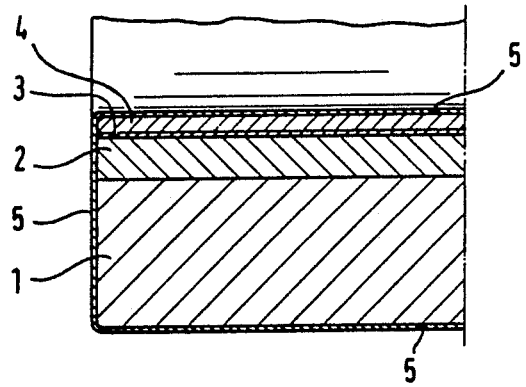
FIG. 3 is a partial section taken on the line III—III of FIG. 2.
Figure 4:
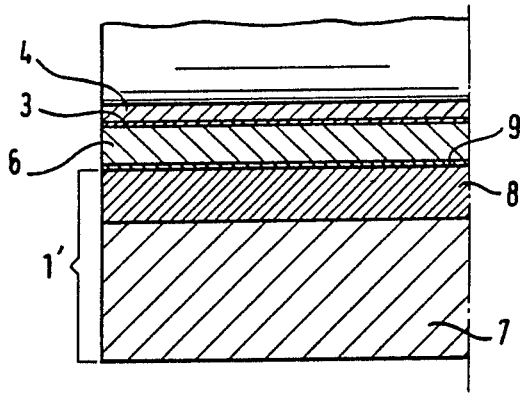
FIG. 4 is a partial section taken on the line III—III of FIG. 2, in a modified embodiment.

FIGS. 2 to 4 show the application of the laminate for bearing cups, i.e. friction bearings assembled to two friction bearing halves.

Provided in the friction bearing shown in FIG. 3 is a metallic supporting part 1 of steel. Directly applied to this supporting layer or part 1 by rolling (cladding) is an anti-friction layer 2 of $AlNi_2Mn_1Bi_2$ in a thickness of from 0.02 mm. to 0.5 mm. This anti-friction layer 2 is coated by electroplating, i.e. galvanically, with a thin nickel film or bonding layer 3 which may be from 0.001 to 0.002 mm. thick. Applied on top of this bonding layer 3 by electroplating is an adaptation or accommodation layer 4 of white metal bearing alloy of the composition $PbSn_{10}Cu_2$ in a thickness from 0.05 to 0.1 mm. The entire laminate is enclosed in a tin or tin/lead alloy corrosion protection film 5, preferably applied by electroplating. This involves a thin flash, hardly visible on the surface of the accommodation layer 4, but offering effective corrosion protection particularly in the area of the support layer 1.

In the Example of FIG. 4, the metallic support layer 1' itself is designed to be the laminate, namely with a steel layer 7 and an intermediate layer 8 with emergency running properties, e.g. of lead-bronze or tin-bronze. An intermediate layer 8 of $AlZn_5$ could also be used, for instance. A thin nickel film 9 (0.001 to 0.002 mm. thick) is applied to this intermediate layer 8 as a diffusion barrier by cathode sputtering. Applied over this nickel film 9 by cathode sputtering, preferably high-power cathode sputtering using magnetic fields, is the anti-friction layer 6 of aluminum/nickel/manganese/-bismuth/copper alloy with 2.5 mass percent nickel, 2 mass percent manganese, 1.2 mass percent bismuth and 0.5 mass percent copper, the rest being aluminum. Even though this anti-friction layer 6 needs no surface machining, so that improved machinability of the bearing material is no consideration, the anti-friction layer benefits in this case from the increased sliding ability and the improved emergency running properties achieved by the addition of the bismuth.

In this Example, the anti-friction layer 6 is again covered by a thin binder layer 3 (0.001 to 0.002 mm thick), applied by cathode sputtering, to which is applied, in turn, by cathode sputtering a run-in layer or accommodation layer 4 of white metal bearing alloy in a thickness from about 0.02 to 0.03 mm. In question for the application of these layers are cathode sputtering coating methods as known, for example, from Hartmut Frey's article, "Cathode Sputtering, Coating Methods with a Future", in German Publication VDI-Zeitung 123 (1981) No. 12, pages 519 to 525. Instead of using cathode sputtering coating methods, the anti-friction layer, the binder layer and the accommodation layer as well as the provided diffusion barrier layers could also be applied by vacuum vaporizing or electroplating.

The legends given in FIG. 1 are self-explanatory. The values indicated by the letter "R" are the values of pressure above which cracks will occur in the various specimens tested. The cross-hatching portions of the bars indicate the ranges where there is no layer fatigue likelihood. The line-shaded portions of the bars indicate those ranges where fatigue normally occurs in the layer, in the prior art devices that have been designated, and have been improved by the present invention, respectively. The formula "$N/mm^2$" is the Newtons force per square millimeter value, or pressure.

The "hard particles" noted above in the aluminum alloys of the aluminum anti-friction layers 2, 6 that have been disclosed, are in actuality formed during cooling of the aluminum alloy anti-friction layer. As presently understood, as the temperature of the (sputtered) layer falls, the solubility of the nickel and manganese in the molten alloy decreases, and accordingly nickel and manganese particles fall out, or precipitate from the molten alloy, and form "hard" particles. In addition, some particles constituted of aluminum-nickel-manganese alloy are formed, also precipitating as "hard" particles.

As the temperature is lowered further, molten aluminum begins to crystallize and solidify, and the manganese particles, and the nickel particles, and aluminum-nickel-manganese alloy particles arrange themselves at the grain boundaries of the crystallizing aluminum. Some intermetallic phases of aluminum-nickel alloy and intermetallic phases of aluminum-manganese alloy and intermetallic phases of aluminum-nickel-manganese alloy may also fall out or precipitate, and form "hard" particles of aluminum-nickel alloy or aluminum-manganese alloy, or aluminum-nickel-manganese alloy. Where copper is added, hard particles of aluminum-nickel-manganese-copper alloy also forms. The just referred to "hard" particles are also arranged during the crystallization of aluminum and locate themselves at the grain boundaries of the solidified aluminum, which can be considered an "aluminum matrix". As presently understood, only a very small amount of nickel and a very small amount of manganese remain in the aluminum matrix, to the extent that it may be properly considered that essentially all of the nickel and manganese ultimately winds up as constituents of the "hard" particles.

Stated differently, the hard particles of nickel and the hard particles of manganese, and the hard particles of aluminum-nickel alloy, and the hard particles of aluminum-manganese alloy, as well as the hard particles of aluminum-nickel-manganese alloy are formed in the aluminum alloy during cooling down from its molten to its solid condition, and appear in an amount which is dependent on the amounts of the nickel and manganese percentages provided in the alloy as applied (by sputtering, for example), and are held to a size which is essentially less than or equal to 5 microns.

The small amount of nickel and manganese that remains in the aluminum matrix depends to a very minor extent, on the rate of cooling. Rapid cooling causes relatively more nickel and manganese to remain in the aluminum matrix. But more prominently, the amount of the hard particles ultimately occurring in the alloy depends almost entirely on the original amount of the manganese and nickel in the alloy.

It is considered that in forming the aluminum alloy, it is believed that the formation of hard particles in the cooled alloy is inherent; applicants have discovered that it is possible to keep the size of such hard particles less than or equal to 5 microns, with the result that an improved bearing results.

The size of the hard particles that are formed is dependent on the cooling rate, but the applicants as of the present date, have not been able to determine or to calculate a defined mathematical or physical formula for the dependence of the particle size as a function of cooling. Applicants have found, however, that it is possible to determine empirically, by experiments, a satisfactory cooling rate for achieving the desired particle size. This cooling rate must be controlled with respect to the conditions and equipment at hand; however, by measuring the final particle sizes, guide lines can be then followed in carrying out later testing and producing of the alloys.

A suitable cooling rate for an actual bearing that has had an aluminum alloy applied thereto is: greater than or equal to 100° C./second, with a starting temperature of 750° C.

In specific alloys, variations in the amount of the following hard particles have been determined to lie in the ranges specified below:

Hard particles of nickel, zero to 1.0% by weight.

Hard particles of manganese, zero to 1.0% by weight.

Hard particles of aluminum-nickel alloy, zero to 5.0% by weight.

Hard particles of aluminum-manganese alloy, zero to 5.0% by weight.

Hard particles of aluminum-nickel-manganese alloy, 15–30% by weight.

With added copper, hard particles of aluminum-nickel-manganese-copper, zero to 10% by weight.

Hard particles which consist essentially of nickel-manganese alloy are rarely formed, because of the tendency for such particles to bind with aluminum, and form the aluminum-nickel-manganese alloy noted above.

The total amount of hard particles is between 20 and 30% by weight.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A laminate for use in forming a friction bearing constituted of a steel support layer and an anti-friction aluminum alloy layer carried by the support layer, said aluminum alloy layer having nickel in the amount of from 1% to 3% by weight and manganese in the amount of from 0.1% to 2.5% by weight, characterized in that said aluminum alloy comprises hard particles selected from the group consisting of nickel, manganese, aluminum-nickel alloy, aluminum-manganese alloy, and aluminum-nickel-manganese alloy, said hard particles being present essentially in the amount of 20–30% by weight.

2. A laminate according to claim 1, wherein the aluminum alloy layer additionally contains bismuth in the amount of from 0.1% to 3% by weight.

3. A laminate according to claim 1, wherein the aluminum alloy layer additionally contains bismuth in the amount of from 1.5% to 2.5% by weight.

4. A laminate according to claim 1, wherein the aluminum alloy layer additionally contains lead in the amount of from 0 to 2% by weight.

5. A laminate according to claim 1, characterized in that the aluminum alloy layer additionally contains copper of between 0.02% and 1.5% by weight.

6. A laminate according to claim 1, characterized in that the aluminum alloy layer additionally contains copper of between 0.03% and 0.8% by weight.

7. A laminate according to claim 1, characterized in that amount of nickel in the aluminum alloy is between 1.5% and 2.5% by weight, and the amount of manganese in the aluminum alloy is between 1% and 2% by weight.

8. A laminate according to claim 1, characterized in that the aluminum alloy layer additionally contains added bismuth of between 0.1% and 3% by weight, and copper of between 0.02% and 1.5% by weight.

9. A laminate according to claim 1, characterized in that the aluminum alloy additionally contains bismuth of between 0.3% and 3% by weight, and copper of between 0.3% and 0.8% by weight.

10. A laminate according to claim 1, characterized in that the amount of hard particles of nickel is from zero to 1.0% by weight.

11. A laminate according to claim 1, characterized in that the amount of hard particles of manganese is from zero to 1.0% by weight.

12. A laminate according to claim 1, characterized in that the amount of hard particles of aluminum-nickel alloy is from zero to 5.0% by weight.

13. A laminate according to claim 1, characterized in that the amount of hard particles of aluminum-manganese alloy is from zero to 5.0% by weight.

14. A laminate according to claim 1, characterized in that the amount of hard particles of aluminum-nickel-manganese alloy is from 15 to 30% by weight.

15. A laminate for use in forming a friction bearing constituted of a steel support layer and an anti-friction aluminum alloy layer carried by the support layer, said aluminum alloy layer having nickel in the amount of from 1% to 3% by weight and manganese in the amount of from 0.1% to 2.5% by weight, said alloy layer comprising hard particles selected from the group consisting of nickel, manganese, aluminum-nickel alloy, aluminum-manganese alloy, and aluminum-nickel-manganese alloy, characterized in that the hard particles are formed in the alloy layer during cooling down from its molten to its solid condition, and appear in an amount which is dependent on the amounts of the nickel and manganese percentages provided in the alloy layer, and are held to a size which is essentially less than or equal to 5 microns.

16. A laminate for use in forming a friction bearing constituted of a steel support layer and an anti-friction aluminum alloy layer carried by the support layer, said aluminum alloy layer having nickel in the amount of from 1% to 3% by weight and manganese in the amount of from 0.1% to 2.5% by weight and copper in the amount of from 0.03% to 0.8% by weight, characterized in that said aluminum alloy comprises hard particles selected from the group consisting of nickel, manganese, aluminum-nickel alloy, aluminum-manganese alloy, aluminum-nickel-manganese alloy, and aluminum-nickel-manganese-copper alloy, said hard particles being present essentially in the amount of 20–30% by weight.

17. A laminate according to claim 16, characterized in that the amount of hard particles of aluminum-nickel-manganese-copper alloy is from zero to 10% by weight.

* * * * *